US012733695B2

(12) United States Patent
Bossuyt et al.

(10) Patent No.: US 12,733,695 B2
(45) Date of Patent: Sep. 15, 2026

(54) TEXTILE DEVICE, A GARMENT AND A METHOD FOR PRODUCING A TEXTILE DEVICE

(71) Applicants: IMEC VZW, Leuven (BE); Universiteit Gent, Ghent (BE)

(72) Inventors: Frederick Bossuyt, Ghent (BE); Paula Veske, Ghent (BE); Bjorn Vandecasteele, Harelbeke (BE); Filip Thielemans, Ghent (BE)

(73) Assignees: IMEC VZW, Leuven (BE); UNIVERSITEIT GENT, Ghent (BE)

( * ) Notice: Subject to any disclaimer, the term of this patent is extended or adjusted under 35 U.S.C. 154(b) by 265 days.

(21) Appl. No.: 18/524,405

(22) Filed: Nov. 30, 2023

(65) Prior Publication Data

US 2024/0180268 A1 Jun. 6, 2024

(30) Foreign Application Priority Data

Dec. 6, 2022 (EP) ..... 22211836

(51) Int. Cl.
*A41D 1/00* (2018.01)
*D03D 1/00* (2006.01)
(Continued)

(52) U.S. Cl.
CPC ..... *A41D 1/005* (2013.01); *D03D 1/00* (2013.01); *D03D 15/533* (2021.01); *D04B 1/24* (2013.01);
(Continued)

(58) Field of Classification Search
None
See application file for complete search history.

(56) References Cited

U.S. PATENT DOCUMENTS 10,314,506 B2 6/2019 Korkala
2009/0076362 A1 3/2009 Jaatinen
(Continued)

FOREIGN PATENT DOCUMENTS

CN 102683996 A 9/2012

OTHER PUBLICATIONS

De Vries et al: "Endurance behavior of conductive yarns", Microelectronics Reliability 54 (2014) pp. 327-330.
(Continued)

*Primary Examiner* — Shawn Mckinnon
(74) *Attorney, Agent, or Firm* — MOSER TABOADA

(57) ABSTRACT

According to an aspect of the present inventive concept there is provided a textile device comprising: a first fabric comprising at least one electrically conductive wire; an electronic component, wherein the electronic component is fixated to the first fabric and wherein the at least one electrically conductive wire is electrically connected to the electronic component; wherein the textile device has a transition region at an area of the first fabric arranged laterally from the electronic component; wherein the textile device further comprises a strengthening element at the transition region, wherein the strengthening element comprises: a second fabric arranged around the first fabric; and a thermoplastic material arranged in relation to at least a first portion of the second fabric, wherein the thermoplastic material is arranged around the first fabric and fills a spacing between the first fabric and the second fabric at least in the first portion of the second fabric.

14 Claims, 5 Drawing Sheets

(51) Int. Cl.
*D03D 15/533* (2021.01)
*D04B 1/24* (2006.01)
*D04B 21/20* (2006.01)

(52) U.S. Cl.
CPC ..... *D04B 21/207* (2013.01); *D10B 2401/18* (2013.01); *D10B 2501/00* (2013.01)

(56) References Cited

U.S. PATENT DOCUMENTS

| | | | |
|---|---|---|---|
| 2012/0052268 | A1 | 3/2012 | Axisa et al. |
| 2017/0181275 | A1 | 6/2017 | Dias et al. |
| 2018/0019213 | A1 | 1/2018 | Dias et al. |
| 2018/0249767 | A1* | 9/2018 | Begriche ..... B32B 5/02 |
| 2018/0302988 | A1 | 10/2018 | Hsu |
| 2018/0317814 | A1 | 11/2018 | Nurkka |
| 2020/0323491 | A1 | 10/2020 | King |

OTHER PUBLICATIONS

Tao et al: "How to Make reliable, Washable, and Wearable Textronic Devices", Sensors 2017, 17, 673, pp. 1-16.

De Vries et al: "Predicting conductive yarn failure in woven electronic textiles", Microelectronics Reliability 54 (2014), pp. 2956-2960.

Hardy et al: "Wash Testing of Electronic Yarn", Materials 2020, 13, 1228, pp. 1-21.

Simegnaw et al: "Review on the Integration of Microelectronics for E-Textile", Materials 2021, 14, 5113, pp. 1-27.

Veske et al: "Testing for Wearability and Reliability of TPU Lamination Method in E-Textiles", Sensors 2022, 22, 156, pp. 1-15.

Linz: "Analysis of failure Mechanisms of machine Embroidered Electrical Contacts and Solutions for Improved Reliability", ISBN 978-90-8578-453-1, 2011, pp. 1-204.

Huang et al: "Delocalizing Strain in Interconnected Joints of On-Skin Interfaces", in 2021 International Symposium on Wearable Computers (ISWC '21), Sep. 21-26, 2021, Virtual, USA. ACM, New York, NY, USA, pp. 91-96.

Veske: "Electronics Integration into Textiles: A Study of Technology, Reliability, Sustainability and Applications", Sep. 2022, ISBN 978-94-6355-624-8, pp. 1-217.

Extended European Search Report for Application No. EP22211836.6 dated May 16, 2023.

* cited by examiner

TEXTILE DEVICE, A GARMENT AND A METHOD FOR PRODUCING A TEXTILE DEVICE

CROSS-REFERENCE TO RELATED APPLICATIONS

The present application claims the benefit of and priority to EP Patent Application Serial No. 22211836.6, filed Dec. 6, 2022, the entire contents of which is incorporated herein by reference.

TECHNICAL FIELD

The present inventive concept relates to the field of electronic textiles.

More particularly, the present inventive concept relates to a textile device comprising an electrically conductive wire and a method for producing such a textile device.

BACKGROUND

Electronic devices are an important part of the everyday life of many people. There is an increasing demand to monitor and analyze different aspects of life. For this, electronics have during the last decade been introduced in new areas such as in textiles.

Electronic components arranged in electronic circuitries distributed over textiles, need to be interconnected with each other in order to have communication in-between electronic components in the textile or between electronic components in the textile and electronic devices located outside the textile. Moreover, electronic circuitries often comprise electronic wires elongated along the textile and interconnecting to rigid parts, such as sensors. Further, having electronic circuitries distributed over textiles puts a demand on the electronic circuitries to be resistant during for instance movement of the textile or during washing of the textile.

The durability of the electronic circuitries is especially challenged at a point where an electrically conductive wire is connected to a sensor. During mechanical load, such as during movement and washing, the connection is challenged with a large force that may case breakage of the wire.

Veske et al. (2021) "Testing for Wearability and Reliability of TPU lamination method in E-textiles", Sensors 2022, Vol. 22, No. 156, discloses, that, to increase durability, wires have been mounted with a buffer structure, for instance such that the wire has a wave pattern making it stretchable. Thus, during bending the wire may be stretched from the wave pattern into a straighter line. Further, different kind of encapsulation of the conductive wire has been shown to increase durability. The methods available do not address the problem of breakage of the wire.

Thus, there is a need in the art for improved designs of electronic textile devices that are more durable during mechanical load.

SUMMARY

It is an object of the present inventive concept to at least partly overcome one or more limitations of the prior art. It is an object to provide a textile device and further a method for producing a textile device, wherein electronic circuitries in the textile device are durable and resistant to wear.

These and other objects are at least partly met by the invention as defined in the independent claims. Preferred embodiments are set out in the dependent claims.

As a first aspect, there is provided a textile device comprising:

- a first fabric comprising at least one electrically conductive wire;
- an electronic component, wherein the electronic component is fixated to the first fabric and wherein the at least one electrically conductive wire is electrically connected to the electronic component;
- wherein the textile device has a transition region at an area of the first fabric arranged laterally from the electronic component;
- wherein the textile device further comprises a strengthening element at the transition region, wherein the strengthening element comprises:
  - a second fabric arranged around the first fabric; and
  - a thermoplastic material arranged in relation to at least a first portion of the second fabric, wherein the thermoplastic material is arranged around the first fabric and fills a spacing between the first fabric and the second fabric at least in the first portion of the second fabric.

The textile device is a device for electronic textiles, such as textiles having conductive wires incorporated into the textile. The textile device may be used for clothes, such as sports clothing or clothing for medical use. The textile may further be used for interior design or as sport textile or for other medical textiles.

The textile device may be a piece of textile that is sown into or otherwise integrated into a manufacture made of textile. Thus, the textile device may for instance be a piece of textile that is arranged in an interior of a jacket or another clothing comprising several layers. However, the textile device may alternatively form a piece of textile which is directly used in forming the manufacture made of textile, such as the textile device forming part of the textile of a clothing. In fact, the textile device may form part of any manufacture that need not even be formed out of textile. Thus, the textile device may form an electronic textile, which may provide an electronic circuitry integrated in textile, wherein the textile device is combined with a manufacture which is otherwise not formed of textile or not entirely formed of textile.

The textile device may be used in a clothing, such as a sports clothing where the electronic component may be used for measuring posture or impact or any other relevant feature for the sport. The textile device may further be used in interior design textile. The electronic component may for instance measure the position of a curtain, such that it is possible to monitor if a window or door is closed or open.

The textile device may be used for monitoring and outputting information from the textile device to an external device. The textile device may further be used for intake of information into the textile device from an external source. Thus, for such a textile device, the textile device may further comprise separate processing means for output and/or input of information from the electronic component.

The electrically conductive wire is a wire for carrying electrical signals. The first fabric may comprise one or several electrically conductive wires. It may for instance be one, two or ten electrically conductive wires. It may be a conductive yarn or a conductive thread, such as metal-based conductive fibers, yarns and fabrics. Thus, the first fabric may be made of conductive fibers, yarns or fabrics or it may comprise a mix of materials wherein one of the materials are conductive fibers, yarns or fabrics. Moreover, the first fabric may be a textile which at least in part is treated with metals to obtain conductivity. The treatment to obtain conductivity may for example be made by electroless deposition, electroplating deposition, physical vapor deposition or chemical vapor deposition. The first fiber may be a yarn which is spun to be sufficiently electrically conductive.

Further, an electrically conductive wire, such as a metal wire, may be mounted on the first fabric. The wire may be mounted in different patterns.

The electronic component may be connected to at least one electrically conductive wire. The electronic component may be electrically connected through the at least one electrically conductive wire to another electronic component. For instance, the electronic component may be connected to a battery for providing power to the electronic component through the electrically conductive wire. Also, or alternatively, the electronic component may receive and/or transmit signals through the electrically conductive wire, e.g., for controlling functionality of the electronic component or for providing sensor data from the electronic component.

The electronic component may be an electronic circuit with multiple components.

The electronic component may be connected to several wires, such as two wires arriving to the electronic component along the first fabric to two opposite sides of the electronic component. Thus, the electronic component may be configured to be connected to other electronic components in any direction along the first fabric. Also, the electronic component may be connected to several wires in a common direction from the electronic component along the first fabric. The several wires may provide different signals to the electronic component or may provide redundancy in electrical connection to the electronic component.

The fixation of the electronic component may be made using an adhesive material to fixate the electronic component to the first fabric. Alternatively, the electronic component may be bonded to the first fabric in another manner. The first fabric may be treated at the fixation point, such that the electrically conductive wire is exposed at the fixation point.

The transition region at an area of the first fabric is a transition region reaching laterally from the electronic component and along a surface of the first fabric. The area of the first fabric may be defined as an area of a surface of the first fabric, although it should be understood that the transition region may surround the first fabric to include opposite sides of the first fabric. The transition region may be arranged laterally from the electronic component, such that the transition region may be arranged outside an area in which the electronic component is fixated to the first fabric and may be laterally displaced from the area of the electronic component, i.e., along a surface of the first fabric. The transition region may be arranged close to the electronic component at a region of the textile device prone to breakage of the electrically conductive wire. The transition region may be arranged close to the electronic component and may extend along a length direction of the first fabric. The transition region may extend in the same direction as the electrically conductive wire. The transition region may be 1-2 cm long, such as 1 cm, 1.5 cm or 2 cm long.

The transition region is one of the places where the risk of damage of the electrically conductive wire is largest. At the transition region, the textile device comprises a strengthening element to reduce the risk of damage. It is an advantage of the present invention that the manufacturing of the strengthening element may easily be integrated into the manufacturing process of the entire textile device. As such, the manufacturing process may not need to be interrupted to add the strengthening element.

The strengthening element comprises a second fabric. The second fabric may be the same kind of fabric as the first fabric. The second fabric may as well be a different kind of fabric. The second fabric is arranged around the first fabric, such that the second fabric is arranged on opposite sides of the first fabric. The second fabric may define a line surrounding a cross-section of the first fabric, wherein the line surrounds the at least one electrically conductive wire but the at least one electrically conductive wire extends transverse to the cross-section. The second fabric may further be arranged around the first fabric by the second fabric being arranged to overlap itself.

The thermoplastic material may be thermoplastic polyurethane (TPU). The thermoplastic material may be arranged in one layer or several layers. A layer of thermoplastic material may be 100-250 μm thick. Thus, it may be 100 μm, 150 μm, 200 μm and 250 μm thick.

The thermoplastic material gives the strengthening element a semi-rigid structure. In other words, the strengthening element is more rigid with thermoplastic material than with only the second fabric, however it is yet still possible to add mechanical load to bend the strengthening element.

Further, the thermoplastic material may function as an attachment of the second fabric to the first fabric at the transition region. In other words, the thermoplastic material may laminate the second fabric to the first fabric at the transition region. Thus, there is no need for a further adhesive material to attach the second fabric to the first fabric.

The strengthening element may be arranged in a point of the textile device wherein a high risk of breakage of the electrically conductive wire exists. For instance, there is a risk of breakage of the electrically conductive wire in a point where the electrically conductive wire is firmly located, e.g., close to the electronic component. In such point, mechanical load due to bending of the textile during use may eventually cause breakage of the electrically conductive wire.

Thus, by the addition of the thermoplastic material, the strengthening element transfers the mechanical load from the sensor in such a way that the risk for damage of the electrically conductive wire is reduced. The electrically conductive wire is elongated through the strengthening element and thus protected by it from damage, since the strengthening element reduces the large difference in stiffness between the electronic component and the first fabric comprising the electrically conductive wire.

The thermoplastic material fills a spacing between the first fabric and the second fabric, such that the thermoplastic material is at least arranged between the first fabric and the second fabric. The thermoplastic material may thus connect the second fabric to the first fabric.

The second fabric may have a first portion forming a portion of the second fabric in the transition region extending along the at least one electrically conductive wire. Thus, the first portion of the second fabric defines a portion of the second fabric surrounding the first fabric. The thermoplastic material is arranged in relation to at least a first portion of the second fabric. This implies that the thermoplastic material needs not necessarily fill a spacing between the first fabric and the second fabric along the entire transition region. However, the thermoplastic material may fill the spacing around the first fabric between the first fabric and the second fabric in at least the first portion of the second fabric.

According to one embodiment the thermoplastic material may further be arranged in relation to a second portion of the second fabric, wherein the thickness of the thermoplastic material arranged in relation to the first portion of the second fabric is larger than the thickness of the thermoplastic material arranged in relation to the second portion of the second fabric, wherein the first portion of the second fabric is located closer to the electronic component than the second portion of the second fabric.

Thus, the thermoplastic material may be arranged along the entire second fabric in a direction along the at least one electrically conductive wire. Further, the thickness of the thermoplastic material may differ along the second fabric such that the thermoplastic material is thicker closer to the electronic component. An advantage with this embodiment is that any mechanical load is further decreased along the second fabric, reducing the risk of breakage. Thus, in the first portion of the second fabric the thermoplastic material is attached both to the first and second fabric. However, along the second portion of the second fabric the thermoplastic material is only attached to the second fabric and thus the first fabric comprising the electrically conductive wire may move freely from the second fabric while yet being enclosed by it to protect it.

According to one embodiment the thermoplastic material may further be arranged on a side of the second fabric facing away from the first fabric.

Thus, the thermoplastic material may be arranged on both sides of the second fabric. The thermoplastic material may be arranged on both sides of the second fabric, at the first portion of the second fabric. The thermoplastic material may be arranged on both sides of the second fabric on the first and second portion of the second fabric.

An advantage of this is that the strength of the second fabric is further increased and the strengthening element as such provides even better protection for the at least one electrically conductive wire.

According to one embodiment the second fabric may be a knitted fabric or a woven fabric. The second fabric may be the same fabric as the first fabric. The second fabric may be a different fabric as the first fabric. The fabric of the second fabric may be chosen depending on the type of textile device. In other words, the second fabric may be chosen differently depending on how the textile device is to be used.

According to one embodiment the electronic component may be covered by an enclosure. The enclosure may be a rigid enclosure or a flexible enclosure. The enclosure may comprise epoxy, polyurethane and/or silicone compounds. An advantage of this embodiment is that the electronic component may be protected from environmental impact, such as scratches, vibration, water or dust.

According to one embodiment the enclosure may cover a part of the transition region, such that the strengthening element partly is arranged under the enclosure. Only having an enclosure may limit movement of the at least one electrically conductive wire such that there is a risk of breakage of the at least one electrically conductive wire at an edge of the enclosure. An advantage of this embodiment, having the enclosure covering a part of the transition region, is that the risk for damage of the at least one electrically conductive wire at an edge of the enclosure is reduced.

According to one embodiment the electrically conductive wire extends along a straight line. The electrically conductive wire may extend along a fiber or a string of the first fiber. An advantage is that, due to the use of the strengthening element, the electrically conductive wire may not need to be arranged in a wave pattern to reduce the risk of damage. Thus, the amount of electrically conductive wire used may be shorter than in the prior art. Also, the electrically conductive wire extending along a straight line may easily be integrated into the first fabric.

However, it should be understood that the conductive wires may extend along a fiber or a string, not being a straight line. It may extend along a zigzag pattern or meandering pattern.

According to one embodiment the electrically conductive wire may be exposed at a fixation point of the electronic component. The first fiber may thus be treated at the fixation point, such that the electrically conductive wire is exposed at the fixation point. An advantage of this embodiment is that a robust connection between the electrically conductive wire and the electronic component may be provided.

According to one embodiment the electronic component may be a sensor, actuator or microcontroller, such as a temperature sensor, a humidity sensor or a movement sensor. It may further be an electronic component comprising several different components. The electronic component may be chosen depending on what the textile device should be used for.

According to a second aspect, there is provided a garment comprising the textile device according to above. The garment may be any textile garment, such as clothes or sports equipment.

Effects and features of this second aspect are largely analogous to those described above in connection with the first aspect. Embodiments mentioned in relation to the first aspect are largely compatible with the second aspect.

The garment may be used to increase performance in sports or to monitor health or environmental factors in a surrounding.

According to a third aspect there is provided a method for producing a textile device, the method comprising:

(a) fixating an electronic component to a first fabric comprising at least one electrically conductive wire, such that the at least one electrically conductive wire is electrically connected to the electronic component, wherein a transition region is defined at an area of the first fabric arranged laterally from the electronic component;

(b) arranging a strengthening element at the transition region, wherein said arranging comprises:

(i) arranging a layer of thermoplastic material at least in relation to a first portion of a second fabric;

(ii) arranging the second fabric around the first fabric, such that the thermoplastic material is arranged around the first fabric, and wherein at least a portion of a first edge of the second fabric is attached to a second edge of the second fabric to create a loop;

(iii) hardening of or laminating the thermoplastic material, such that the thermoplastic material fills a spacing between the first fabric and the second fabric.

In one embodiment, the method for producing a textile device comprises:

(a) fixating an electronic component to a first fabric comprising at least one electrically conductive wire, such that the at least one electrically conductive wire is electrically connected to the electronic component, wherein a transition region is defined at an area of the first fabric arranged laterally from the electronic component;

(b) arranging a strengthening element at the transition region, wherein said arranging comprises:

(i) arranging a layer of thermoplastic material on the second fabric;

(ii) hardening or laminating the thermoplastic material on the second fabric;

(iii) arranging the laminated second fabric from (ii) around the first fabric, wherein at least a portion of a first edge of second fabric is attached to a second edge of the second fabric to create a loop;

(iv) hardening or laminating the thermoplastic at the strengthening element, such that the thermoplastic material fills a spacing between the first fabric and the second fabric.

Effects and features of this third aspect are largely analogous to those described above in connection with the first and second aspects. Embodiments mentioned in relation to the first and second aspects are largely compatible with the third aspect.

The fixation of the electronic component to the first fabric may be made by first exposing the at least one electrically conductive wire at a point of fixation. The fixation is made to ensure electrical connection between the electronic component and the at least one electrically conductive wire. The electronic component may be a sensor, actuator or microcontroller, such as a temperature sensor, a humidity sensor or a movement sensor.

The transition region should be understood as an area displaced laterally from the electronic component and reaching along the first fabric. The transition region may for instance be 1-2 cm along the first fabric.

The second fabric is arranged around the first fabric, to create a loop around it. When the second fabric is looped around the first fabric, the thermoplastic material is arranged at least between the first fabric and the second fabric and at least along a first portion of the second fabric. The first portion of the second fabric may be located closer to the electronic component than a second portion.

The hardening or lamination of the thermoplastic may be made at a temperature of 130-180 degrees, for 10-60 seconds and under a pressure of 2-5 bar. As an example, the temperature is 170 degrees for 40 seconds under 4 bar pressure.

In the alternative embodiment, the hardening or lamination is made in two steps. First, the thermoplastic material may be arranged in relation to the second fabric and the first hardening or lamination is made before the second fabric with the thermoplastic is arranged around the first plastic. Thus, the first hardening or lamination may be made for adhering two ends of the second fabric together in order to form the loop. To adhere the second fabric around the first fabric, a second step of hardening or lamination is made.

According to one embodiment in (b)(ii) the thermoplastic material may further be arranged in relation to a second portion of the second fabric, wherein the thickness of the layer arranged in relation to the first portion of the second fabric is larger than the thickness of the thermoplastic material arranged in relation to the second portion of the second fabric.

As has already been discussed, this may be advantageous since any mechanical load is further decreased along the second fabric, reducing the risk of breakage.

According to one embodiment in (b)(i) a temporary protection layer may be arranged between the first fabric and the thermoplastic material arranged in relation to the second portion of the second fabric, wherein the method after (b)(iii) further comprises (b)(iv) removing the temporary protection material.

The temporary protection layer may serve as a protection such that the thermoplastic material does not adhere to the first fabric. In this embodiment, the thermoplastic material adheres to the first and second fabric along the first portion of the second fabric, but only to the second portion of the second fabric. An advantage of this embodiment is that the first fabric comprising at least one electrically conductive wire may move freely from the second fabric while still being protected by the second fabric, along the second portion of the second fabric.

According to one embodiment in (b)(ii) two layers of the thermoplastic material may be arranged at opposite sides of the second fabric.

As has already been discussed, an advantage of this is that the strength of the second fabric is further increased and the strengthening element as such provides even better protection for the at least one electrically conductive wire.

According to one embodiment after (b)(iii) an enclosure is arranged such that it covers the electronic component.

The enclosure may be a rigid enclosure or a flexible enclosure. The enclosure provides the electronic component with protection from environmental damage such as scratches, vibration, water or dust. Further, the enclosure may be arranged such that it partly covers the strengthening element or such that an edge of the enclosure aligns with the strengthening element.

BRIEF DESCRIPTION OF THE DRAWINGS

The above, as well as additional objects, features and advantages of the present inventive concept, will be better understood through the following illustrative and non-limiting detailed description, with reference to the appended drawings. In the drawings like reference numerals will be used for like elements unless stated otherwise.

DETAILED DESCRIPTION

Figure 1A:
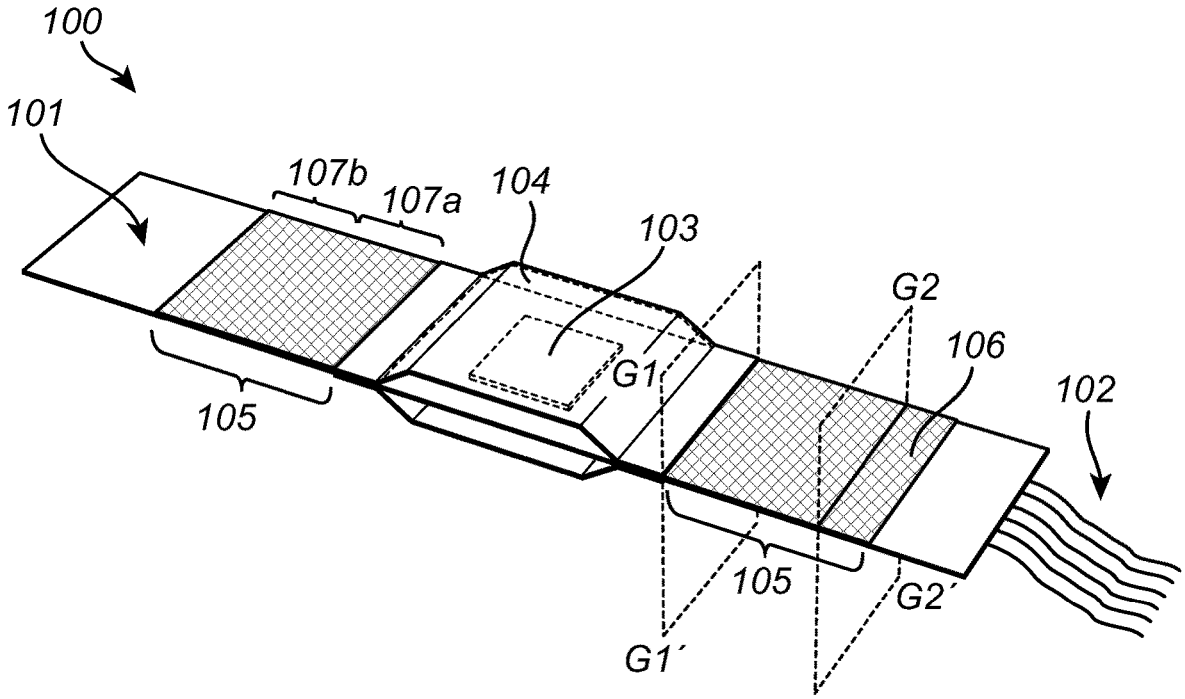
FIG. 1*a* is a perspective view of a textile device according to a first embodiment.

FIG. 1*a* illustrates a perspective view of a part of a textile device 100. The textile device 100 comprises a first fabric 101. The first fabric 101 may be a knitted or woven fabric, or any other kind of fabric. The first fabric 101 comprises at least one electrically conductive wire 102. The electrically conductive wire 102 is a wire for carrying electrical signals. In FIG. 1*a* four electrically conductive wires 102 are shown, however it should be understood that it may be 1, 2, 3, 10 or 40 number of wires. The at least one electrically conductive wire 102 extends along a straight line along a longitudinal extension of the first fabric 101. However, it should be understood that the conductive wires may extend along a fiber or a string, not being a straight line. It may extend along a zigzag pattern or meandering pattern. Further, it should be understood that the electrically conductive wire 102, such as a metal wire, may be mounted on the first fabric 101. However, also or additionally the first fabric 101 may be made of conductive fibers, yarns or fabrics or it may comprise a mix of materials wherein one of the materials are conductive fibers, yarns or fabrics. Moreover, the first fabric 101 may be a textile which at least in part is treated with metals to obtain conductivity. Thus, the electrically conductive wire 102 may be integrated into the first fabric 101.

The textile device 100 further comprises an electronic component 103. The electronic component 103 is fixated to the first fabric 101 and in electrical connection to the at least one electrically conductive wire 102. The electronic component 103 may be electrically connected through the at least one electrically conductive wire 102 to another electronic component. For instance, the electronic component 103 may be connected to a battery for providing power to the electronic component 103 through the electrically conductive wire.

As can be seen in FIG. 1*a*, the first fabric 101 as well as the at least one electrically conductive wire 102 may extend on opposite sides of the electronic component 103. Thus, the at least one electrically conductive wire 102 may connect to a plurality of electronic components 103 along the first fabric 101. The electronic component 103 may be a sensor, actuator or microcontroller, such as a temperature sensor, a humidity sensor or a movement sensor.

The electronic component 103 is covered by an enclosure 104. The enclosure 104 is in FIG. 1*a* depicted as a rigid enclosure 104, however the enclosure may be a flexible enclosure 104 as well. Further, the size and shape of the enclosure 104 may vary depending on the use of the textile device 100. The enclosure 104 may comprise epoxy, polyurethane and/or silicone compounds.

Further, the textile device 100 has a transition region 105 at an area of the first fabric 101 arranged laterally from the electronic component 103. As is illustrated in FIG. 1*a*, the electronic component 103 is arranged with the first fabric 101 reaching out on two sides of the electronic component 103. Thus, transition regions 105 are located on both lateral sides of the electronic component 103. At the transition region 105, the risk for breakage of the at least one electrically conductive wire is extra high due to the change from the stiffer electronic component 103 and/or the enclosure 104 to the softer first fabric 101. The transition region 105 may be 1-4 cm long, such as 1 cm, 1.5 cm, 2 cm, 2.5 cm, 3 cm, 3.5 cm or 4 cm long.

To reduce the risk of damage to the at least one electrically conductive wire 102, the textile device 100 comprises a strengthening element 106 at the transition region 105. The strengthening element 106 is partly arranged under the enclosure 104 covering the electronic component 103, such that the enclosure 104 overlaps the strengthening element 106. The strengthening element 106 comprises a second fabric 107 arranged around the first fabric 101. The strengthening element may further be divided into a first portion 107*a* and a second portion 107*b*. In FIG. 1*a*, the first portion 107*a* is arranged closer to the electronic device 103 and the rigid enclosure 104 than the second portion 107*b*. However, it should be understood that it could be the other way around. Thus, for all embodiments disclosed, the first portion 107*a* may be arranged closer to the electronic component 103 than the second portion 107*b* or the second portion 107*b* may be arranged closer to the electronic component 103 than the first portion 107*a*.

The strengthening element 106 further comprises a thermoplastic material 108. The thermoplastic material 108 cannot be seen in FIG. 1*a* but will be more discussed in relation to further figures. The thermoplastic material 108 is arranged in relation to at least the first portion 107*a* of the second fabric 107. The thermoplastic material 108 is arranged around the first fabric 101 and fills a spacing between the first fabric 101 and the second fabric 107 at least in the first portion 107*a* of the second fabric 107.

Figure 1B:
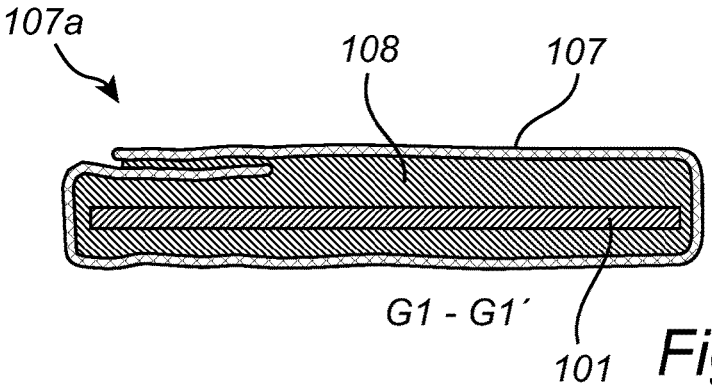
FIG. 1*b* is a cross section of the textile device of FIG. 1*a*.

FIG. 1*b* illustrates a cross section of the textile device 100 at the cross-sectional area G1 in FIG. 1*a*. The cross section shows the first portion 107*a* of the second fabric 107 of the strengthening element 106. The second fabric 107 is arranged around the first fabric 101 surrounding the cross-section of the first fabric 101. As can be seen in FIG. 1*a*, the second fabric 107 may be looped around the first fabric 101. The second fabric 107 may be a woven fabric or a knitted fabric.

Moreover, the strengthening element 106 comprises a thermoplastic material 108. The thermoplastic material 108 may be thermoplastic polyurethane (TPU). As illustrated in FIG. 1*b*, the thermoplastic material 108 is arranged in one layer. However, it should be understood that it may be arranged in several layers. A layer of thermoplastic material may be 100-250 μm thick. Thus, it may be 100 μm, 150 μm, 200 μm and 250 μm thick.

The thermoplastic material 108 is arranged in relation to at least the first portion 107*a* of the second fabric 107. The first portion 107*a* of the second fabric 107 may be arranged closer to the electronic device 103 than a second portion 107*b* of the second fabric 107. As is shown in FIG. 1*b*, the thermoplastic material 108 is arranged around the first fabric 101, in a corresponding way as the second fabric 107 and fills a spacing between the first fabric 101 and the second fabric 107. Thus, the thermoplastic material 108 aligns the first fabric 101 and the second fabric 107, such that it both fills the spacing between the first fabric 101 and the second fabric 107 and further fills the overlap of the second fabric 107 when it loops around the first fabric 101. Thus, the thermoplastic material 108 may be used to attach one end of the second fabric 107 to a second end of the second fabric 107 for forming a loop of the second fabric 107.

Figure 1C:
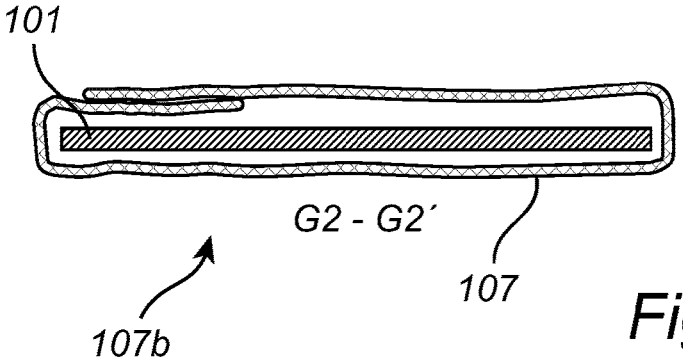
FIG. 1*c* is a cross section of the textile device of FIG. 1*a*.

FIG. 1*c* illustrates a cross section of one embodiment of the textile device 100 at the cross-sectional area G2 in FIG. 1*a*. The cross section shows the second portion 107*b* of the second fabric 107 of the strengthening element 106.

The second fabric 107 is arranged around the first fabric 101. However, there is no thermoplastic material 108 arranged in between the first fabric 101 and the second fabric 107 at the second portion 107*b*. Thus, the second fabric 107 is looped around the first fabric 101, but it is not attached to the first fabric 101 at the second portion 107*b*.

Figure 2A:
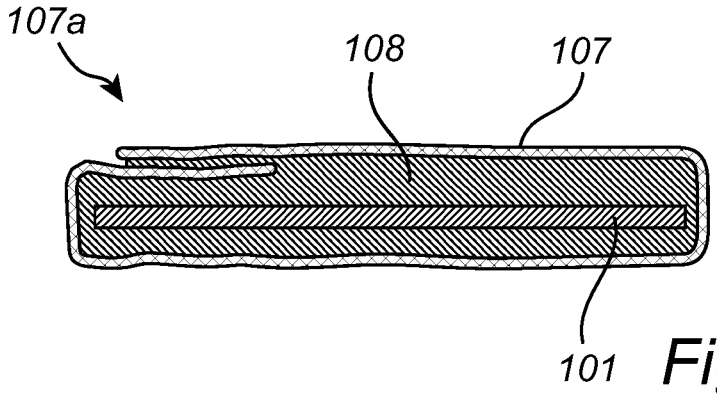
FIG. 2*a* is a cross section of the textile device of FIG. 1*a*.

FIG. 2*a* illustrates a cross section of the textile device 100 at the cross-sectional area G1 in FIG. 1*a* according to a second embodiment. For reasons of simplicity, the similarities between FIG. 1*b* and FIG. 2*a* are not repeated.

FIG. 2*a* illustrates an embodiment having a similar cross-section of the strengthening element 106 as in FIG. 1*b*. Thus, the strengthening element comprises a second fabric 107 arranged around the first fabric 101. Further, thermoplastic material 108 is arranged at the first portion 107*a* of the second fabric 107.

Figure 2B:
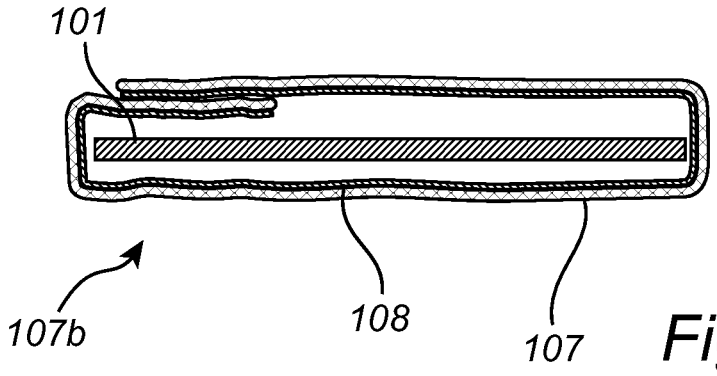
FIG. 2*b* is a cross section of the textile device of FIG. 1*a*.

FIG. 2*b* illustrates a cross section of the textile device 100 at the cross-sectional area G2 in FIG. 1*a*. The cross-sectional area of FIG. 2*b* illustrates the second portion 107*b* of the second fabric 107. As can be seen in FIG. 2*b*, the thermoplastic material 108 is further arranged in relation to the second portion 107*b* of the second fabric 107. The thermoplastic material 108 arranged in relation to the first portion 107*a* of the second fabric 107 has a larger thickness than the thermoplastic material 108 being arranged in relation to the second portion 107*b* of the second fabric 107.

It should however be understood that the thermoplastic material 108 arranged in relation to the second portion 107*b* of the second fabric 107 could as well have the same thickness as the thermoplastic 108 arranged in relation to the first portion 107*a* of the second fabric 107.

Figure 3A:
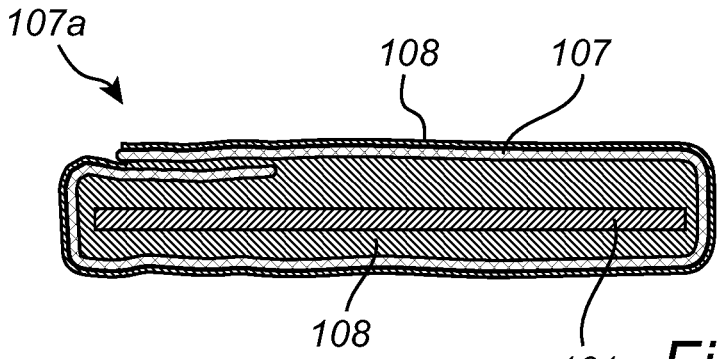
FIG. 3*a* is a cross section of the textile device of FIG. 1*a*.

FIG. 3*a* illustrates a cross section of the textile device 100 at the cross-sectional area G1 according to a third embodiment. For reasons of simplicity, the similarities between FIG. 1*b*, FIG. 2*a* and FIG. 3*a* are not repeated.

FIG. 3*a* illustrates that the thermoplastic material 108 is further arranged on a side of the second fabric 107 facing away from the first fabric 101. Thus, in addition to having the thermoplastic material 108 arranged between the first fabric 101 and the second fabric 107, the thermoplastic material 108 may also be arranged on the outside of the second fabric 107.

As illustrated in FIG. 3*a*, the thermoplastic material 108 arranged between the first fabric 101 and the second fabric 107 and arranged in relation to the first portion 107*a* of the second fabric 107 fills the spacing between the first fabric 101 and the second fabric 107.

Figure 3B:
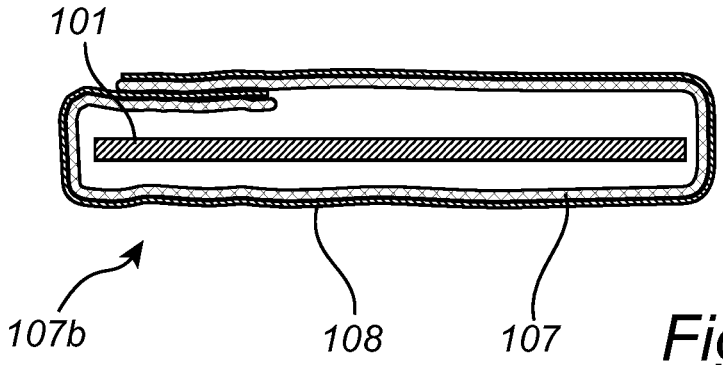
FIG. 3*b* is a cross section of the textile device of FIG. 1*a*.

FIG. 3*b* illustrates a cross section of the textile device 100 at the cross-sectional area G2 in FIG. 1*a*. The cross-sectional area of FIG. 3*b* illustrates the second portion 107*b* of the second fabric 107. As can be seen in FIG. 3*b*, the thermoplastic material 108 is at the second portion 107*b* of the second fabric 107 arranged on a side of the second fabric 107 facing away from the first fabric 101. However, it should be understood that this may not be true for all embodiments. In some embodiments, there may be no thermoplastic material 108 arranged in relation to the second portion 107*b* of the second fabric 107.

Further, it should be realized that the thermoplastic material 108 may also be arranged on the side of the second fabric 107 facing the first fabric 101.

Figure 4:
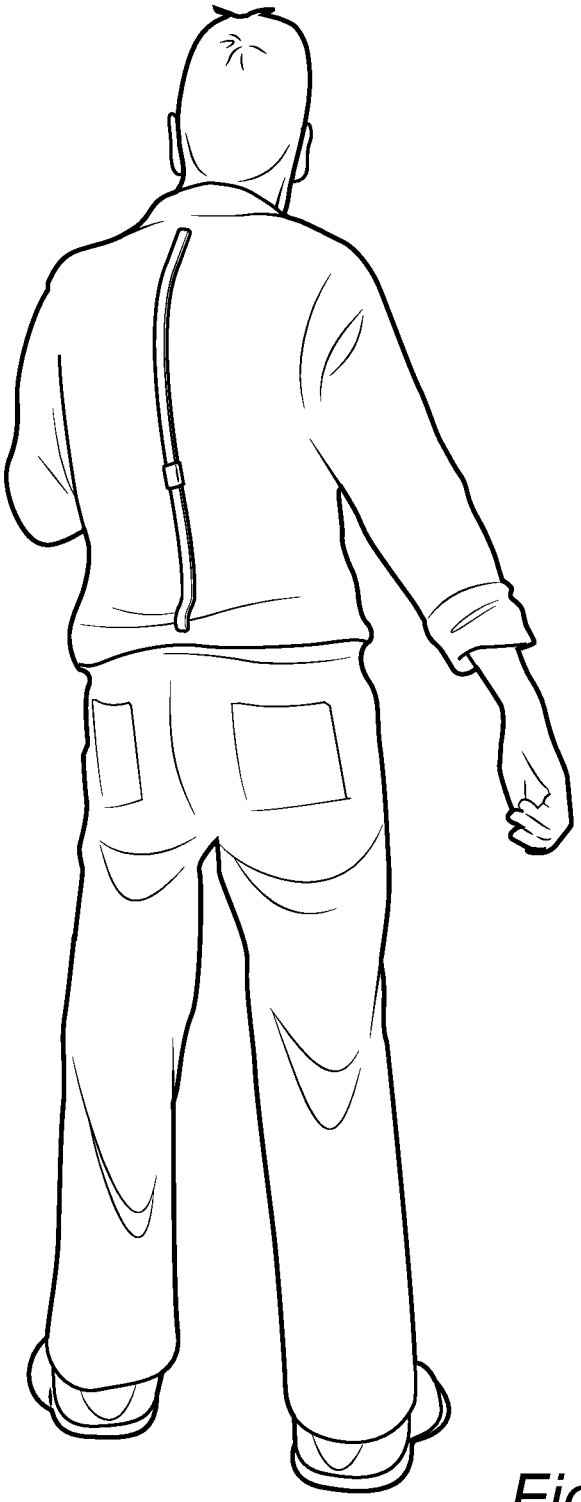
FIG. 4 is a garment comprising the textile device.

FIG. 4 illustrates a garment 200 comprising the textile device 100. As illustrated in FIG. 4, the garment 200 may be a jacket or any other clothing, comprising a textile device 100. The textile device 100 may have a sensor as the electronic component 103, such that the jacket is a smart jacket allowing the user to gain information from the sensor.

Figure 5:
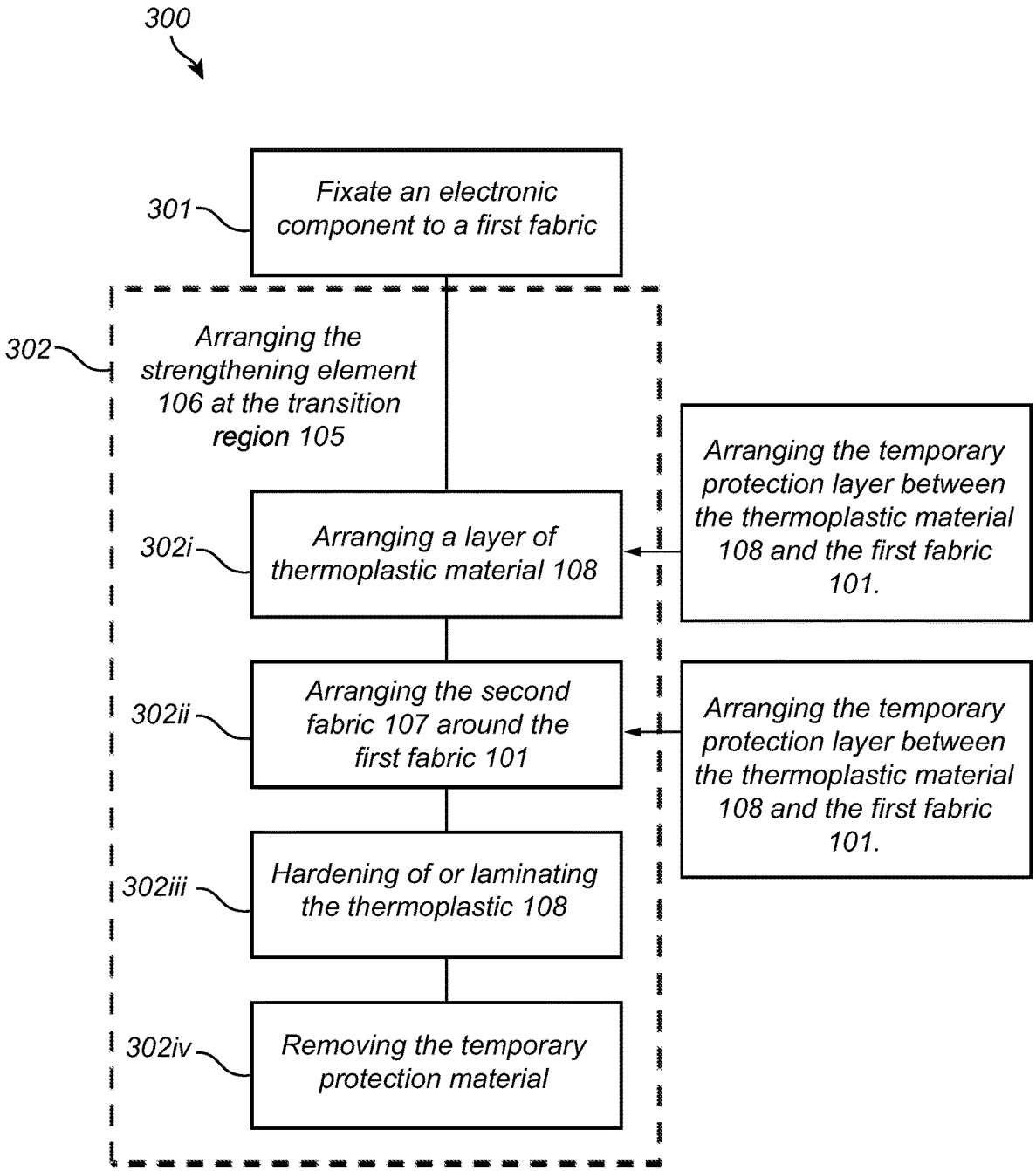
FIG. 5 is a method for producing a textile device.

FIG. 5 illustrates a method 300 for producing the textile device 100. The method 300 comprises fixating 301 the electronic component 103 to the first fabric 101. The fixating is made such that the at least one electrically conductive wire 102 is electrically connected to the electronic component 103. This may be made by exposing the at least one electrically conductive wire 102 at the point of fixation of the electronic component 103.

When the electronic component 103 is fixated to the first fabric 101, the transition region 105 is defined as an area of the first fabric arranged laterally from the electronic component 103.

The method further comprises arranging 302 the strengthening element 106 at the transition region 105. The arranging 302 comprises arranging 302*i* a layer of thermoplastic material 108 at least in relation to a first portion 107*a* of a second fabric 107. Further, the second fabric 107 is arranged 302*ii* around the first fabric 101, such that the thermoplastic material 108 is arranged around the first fabric 101. At least a portion of a first edge of second fabric 107 is attached to a second edge of the second fabric 107 to create a loop. Thus, the second fabric 107 is arranged 302 around the first fabric 101 and attached to itself to create a closed loop. As an alternative, the thermoplastic material 108 can be further arranged in relation to a second portion 107*b* of the second fabric 107. The thickness of the thermoplastic material 108 may be larger for the thermoplastic material arranged in relation to the first portion 107*a* than the thermoplastic material 108 arranged in relation to the second portion 107*b* of the second fabric 107.

If a thermoplastic material 108 is arranged in relation to the second portion 107*b* of the second fabric 107, a temporary protection layer is arranged between the first fabric 101 and the thermoplastic material 108 arranged in relation to the second portion 107*b* of the second fabric 107. This may be done after 302*i* or after 302*ii*, but before 302*iii*. The temporary protection layer serves the purpose of hindering the thermoplastic material 108 to adhere to the first fabric 101.

Even further, the thermoplastic material 108 may be arranged at opposite sides of the second fabric 107. This may be made during step 302*ii*.

Then, the method may comprise a hardening 302*iii* of or laminating the thermoplastic material 108, such that the thermoplastic material 108 fills a spacing between the first fabric 101 and the second fabric 107. The hardening may be made at temperature 130-180 degrees, for the time 10-60 seconds and under 2-5 bar pressure.

If a temporary protection layer is arranged between the first fabric 101 and the thermoplastic material 108, the method further comprises removing 302*iv* the temporary protection material.

Moreover, an enclosure 104 may be arranged such that it covers the electronic component 103. Further, the enclosure 104 may be arranged such that it partly covers the transition region 105, in such a way that it overlaps with the strengthening element 106.

Figure 6:
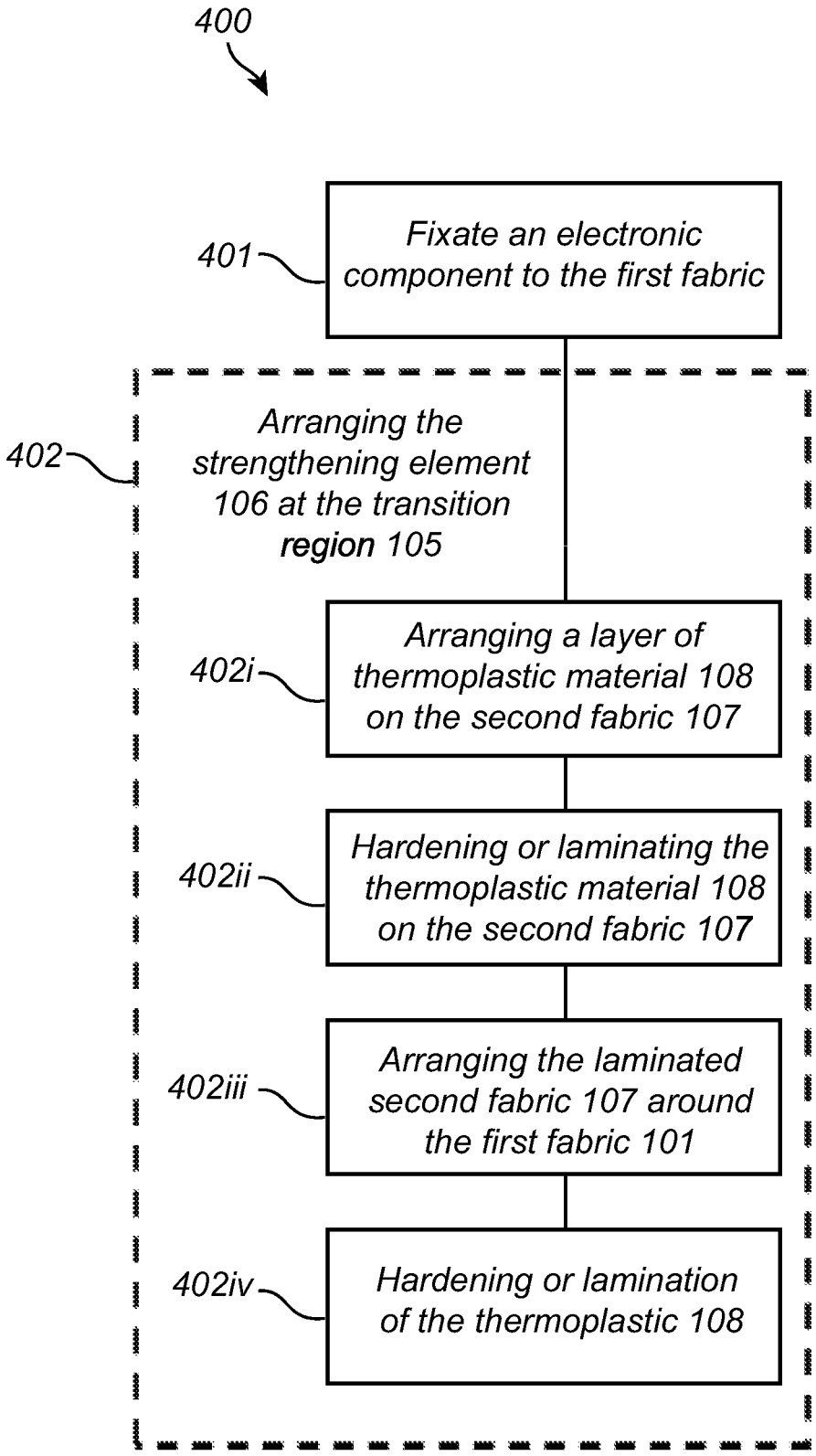
FIG. 6 is an alternative method for producing the textile device.

FIG. 6 illustrates an alternative method 400 for producing a textile device 100. The method 400 comprises fixating 401 an electronic component 103 to the first fabric 101 comprising at least one electrically conductive wire 102. During fixation 401, the at least one electrically conductive wire 102 is electrically connected to the electronic component 103. After fixation, a transition region 105 is defined at an area of the first fabric laterally from the electronic component 103 and the first fabric 101.

Further, the method 400 comprises arranging 402 a strengthening element 106 at the transition region 105. The arranging 402 comprises arranging 402*i* a layer of thermoplastic material 108 on the second fabric 107.

The method further comprises hardening 402*ii* or laminating 402*ii* the thermoplastic material 108 on the second fabric 107. The hardening or lamination is made at a temperature of 130-180 degrees, for the time 10-60 seconds and under 2-5 bar pressure.

After hardening or lamination 402*ii*, the laminated second fabric 107 is arranged 402*iii* around the first fabric 101. At least a portion of a first edge of second fabric 107 is attached to a second edge of the second fabric 107 to create a loop. Thus, the second fabric 107 is arranged around the first fabric 101 and overlaps itself to create a loop.

To attach the laminated second fabric 107, there is a second hardening 402*iv* or lamination 402*iv* of the thermoplastic 108 at the strengthening element 106, such that the thermoplastic material 108 fills a spacing between the first fabric 101 and the second fabric 107.

In the above the inventive concept has mainly been described with reference to a limited number of examples. However, as is readily appreciated by a person skilled in the art, other examples than the ones disclosed above are equally possible within the scope of the inventive concept, as defined by the appended claims.

The invention claimed is:

1. A textile device comprising:

a first fabric comprising at least one electrically conductive wire;

an electronic component, wherein the electronic component is bonded to the first fabric, wherein the electronic component is covered by an enclosure and wherein the at least one electrically conductive wire is electrically connected to the electronic component;

wherein the textile device has a transition region at an area of the first fabric arranged laterally from the electronic component;

wherein the textile device further comprises a strengthening element at the transition region, wherein the strengthening element comprises:

a second fabric arranged around the first fabric; and a thermoplastic material arranged in relation to at least a first portion of the second fabric, wherein the thermoplastic material is arranged around the first fabric and fills a spacing between the first fabric and the second fabric at least in the first portion of the second fabric, wherein the enclosure covers a part of the transition region such that the strengthening element partly is arranged under the enclosure.

2. The textile device according to claim 1, wherein the thermoplastic material is further arranged in relation to a second portion of the second fabric, wherein the thickness of the thermoplastic material arranged in relation to the first portion of the second fabric is larger than the thickness of the thermoplastic material arranged in relation to the second portion of the second fabric, wherein the first portion of the second fabric is located closer to the electronic component than the second portion of the second fabric.

3. The textile device according to claim 1, wherein the thermoplastic material is further arranged on a side of the second fabric facing away from the first fabric.

4. The textile device according to claim 1, wherein the second fabric is a knitted fabric or a woven fabric.

5. The textile device according to claim 1, wherein the electrically conductive wire extends along a straight line.

6. The textile device according to claim 1, wherein the electrically conductive wire is exposed at a fixation point of the electronic component.

7. The textile device according to claim 1, wherein the electronic component is a sensor, actuator or microcontroller.

8. A garment comprising the textile device according to claim 1.

9. A method for producing a textile device, the method comprising:

(a) bonding an electronic component to a first fabric comprising at least one electrically conductive wire, such that the at least one electrically conductive wire is connected to the electronic component, wherein a transition region is defined at an area of the first fabric arranged laterally from the electronic component;

(b) arranging a strengthening element at the transition region, wherein said arranging comprises:

(i) arranging a layer of thermoplastic material at least in relation to a first portion of a second fabric;

(ii) arranging the second fabric around the first fabric, such that the thermoplastic material is arranged around the first fabric, and wherein at least a portion of a first edge of the second fabric is attached to a second edge of the second fabric to create a loop; and (iii) hardening of or laminating the thermoplastic material, such that the thermoplastic material fills a spacing between the first fabric and the second fabric; and (c) arranging an enclosure such that it covers the electronic component and covers a part of the transition region such that the strengthening element partly is arranged under the enclosure.

10. The method according to claim 9, wherein in (b)(ii) the thermoplastic material is further arranged in relation to a second portion of the second fabric, wherein the thickness of the layer arranged in relation to the first portion of the second fabric is larger than the thickness of the thermoplastic material arranged in relation to the second portion of the second fabric.

11. The method according to claim 10, wherein in (b)(i) or in (b)(ii) a temporary protection layer is arranged between the first fabric and the thermoplastic material arranged in relation to the second portion of the second fabric, wherein the method after (b)(iii) further comprises (b)(iv) removing the temporary protection material.

12. The method according to claim 9, wherein in (b)(ii) two layers of the thermoplastic material are arranged at opposite sides of the second fabric.

13. The textile device according to claim 1, wherein the electronic component is a temperature sensor, a humidity sensor, or a movement sensor.

14. A textile device comprising:

a first fabric comprising at least one electrically conductive wire;

an electronic component, wherein the electronic component is bonded to the first fabric, wherein the electronic component is covered by an enclosure and wherein the at least one electrically conductive wire is electrically connected to the electronic component;

wherein the textile device has a transition region at an area of the first fabric arranged laterally from the electronic component;

wherein the textile device further comprises a strengthening element at the transition region, wherein the strengthening element comprises:

a second fabric arranged around the first fabric; and a thermoplastic material arranged in relation to at least a first portion of the second fabric, wherein the thermoplastic material is arranged around the first fabric and fills a spacing between the first fabric and the second fabric at least in the first portion of the second fabric, wherein the thermoplastic material is further arranged in relation to a second portion of the second fabric, wherein the thickness of the thermoplastic material arranged in relation to the first portion of the second fabric is larger than the thickness of the thermoplastic material arranged in relation to the second portion of the second fabric, wherein the first portion of the second fabric is located closer to the electronic component than the second portion of the second fabric.

* * * * *